US010151540B2

(12) United States Patent
Kondo et al.

(10) Patent No.: US 10,151,540 B2
(45) Date of Patent: Dec. 11, 2018

(54) REBOILER WITH VOID WITHIN THE HEAT TRANSFER TUBE GROUP

(75) Inventors: Yoshiyuki Kondo, Tokyo (JP); Hiromitsu Nagayasu, Tokyo (JP); Takashi Kamijo, Tokyo (JP); Osamu Miyamoto, Hiroshima (JP)

(73) Assignee: MITSUBISHI HEAVY INDUSTRIES ENGINEERING, LTD., Yokohama-shi (JP)

( * ) Notice: Subject to any disclaimer, the term of this patent is extended or adjusted under 35 U.S.C. 154(b) by 615 days.

(21) Appl. No.: 14/002,608

(22) PCT Filed: Nov. 29, 2011

(86) PCT No.: PCT/JP2011/077491

§ 371 (c)(1),
(2), (4) Date: Aug. 30, 2013

(87) PCT Pub. No.: WO2012/132113

PCT Pub. Date: Oct. 4, 2012

(65) Prior Publication Data

US 2013/0333866 A1 Dec. 19, 2013

(30) Foreign Application Priority Data

Mar. 30, 2011 (JP) ..... 2011-074664

(51) Int. Cl.
*F28D 7/16* (2006.01)
*F25B 35/00* (2006.01)
(Continued)

(52) U.S. Cl.
CPC ..... *F28D 7/1607* (2013.01); *F25B 35/00* (2013.01); *F28D 7/0075* (2013.01); *F28D 7/06* (2013.01)

(58) Field of Classification Search
CPC ..... F28D 7/06; F28D 7/1607; F28D 7/0075; F25B 35/00
(Continued)

(56) References Cited

U.S. PATENT DOCUMENTS 1,562,682 A * 11/1925 Braun ..... F28B 1/02 165/110
2,254,189 A * 8/1941 Reed ..... F28F 9/0239 165/157
(Continued)

FOREIGN PATENT DOCUMENTS

DE 1451199 A 1/1970
EP 2241848 A2 10/2010
(Continued)

OTHER PUBLICATIONS

Notification of Transmittal of Translation of the International Preliminary Report on Patentabililty (Form PCT/IB/338) of International Application No. PCT/JP2011/077491 dated Oct. 10, 2013 with Forms PCT/IB/373 and PCT/ISA/237.
(Continued)

*Primary Examiner* — Claire Rojohn, III
(74) *Attorney, Agent, or Firm* — Westerman, Hattori, Daniels & Adrian, LLP

(57) ABSTRACT

There is provided a large-sized reboiler that can achieve space saving and reduction in plant cost. Specifically, there is provided a large-sized reboiler comprising a vessel of which a liquid is supplied from a lower part and a vaporized gas is discharged from an upper part; and a heat transfer tube group arranged in such a manner that a void penetrating in the up-and-down direction is formed in the vessel, wherein a maximum length of a cross-sectional figure of a flow path for the liquid exceeds 2 m, and the void occupies 5 to 10% of an area of the cross-sectional figure of the flow path.

1 Claim, 4 Drawing Sheets

(51) Int. Cl.
*F28D 7/00* (2006.01)
*F28D 7/06* (2006.01)

(58) Field of Classification Search
USPC ..... 165/110, 159, 160
See application file for complete search history.

(56) References Cited

U.S. PATENT DOCUMENTS

| | | | | | |
|---|---|---|---|---|---|
| 3,191,674 | A * | 6/1965 | Richardson | F28D 7/06 | 165/158 |
| 3,267,693 | A * | 8/1966 | Richardson | F25B 39/02 | 165/160 |
| 3,587,732 | A * | 6/1971 | Burne | F28D 7/1669 | 165/158 |
| 3,735,811 | A * | 5/1973 | Moser | F28D 7/1661 | 165/160 |
| 4,972,903 | A * | 11/1990 | Kwok | F28D 7/06 | 165/158 |
| 6,497,115 | B1 * | 12/2002 | Shirakata | F25B 39/02 | 165/111 |
| 6,655,173 | B2 * | 12/2003 | Iritani | F25B 39/02 | 62/219 |
| 7,028,762 | B2 * | 4/2006 | Iritani | F25B 39/04 | 165/110 |
| 2002/0157417 | A1 * | 10/2002 | Iritani | F25B 39/02 | 62/515 |
| 2007/0227469 | A1 * | 10/2007 | Ruchti | F22B 1/18 | 122/7 R |
| 2010/0282448 | A1 * | 11/2010 | Singh | F22B 1/006 | 165/135 |
| 2010/0307726 | A1 * | 12/2010 | Chiu | B01J 8/067 | 165/173 |

FOREIGN PATENT DOCUMENTS

| | | | |
|---|---|---|---|
| JP | 56-093601 | U | 7/1981 |
| JP | 05-146602 | A | 6/1993 |
| JP | 2972420 | B2 | 8/1999 |
| JP | 2002-13841 | A | 1/2002 |
| JP | 2002-349999 | A | 12/2002 |
| JP | 2003-517560 | A | 5/2003 |
| JP | 2004-92991 | A | 3/2004 |
| JP | 2005-016819 | A | 1/2005 |
| JP | 2005-042957 | A | 2/2005 |
| JP | 2008-138991 | A | 6/2008 |
| JP | 2011-020090 | A | 2/2011 |
| WO | 99/32837 | A1 | 7/1999 |
| WO | 01/44730 | A1 | 6/2001 |
| WO | 02/42696 | A1 | 5/2002 |

OTHER PUBLICATIONS

International Search Report dated Jan. 31, 2012, issued in corresponding application No. PCT/JP2011/077491.
Japanese Office Action dated Aug. 1, 2014, issued in corresponding Japanese Patent Application No. 2011-074664 with English translation (4 pages).
Office Action dated Jan. 27, 2015, issued in corresponding Japanese Patent Application No. 2011-074664, with English translation (6 pages).
Extended European Search Report dated Feb. 12, 2015, issued in corresponding European Patent Application No. 11862437.8 (7 pages).
Notice of Allowance dated Jun. 12, 2015, issued in corresponding Japanese Patent Application No. 2011-074664 with English translation (6 pages).
Notice of Acceptance dated Jun. 3, 2015, issued in corresponding Australian Patent Application No. 2011364036 (20 pages).

* cited by examiner

REBOILER WITH VOID WITHIN THE HEAT TRANSFER TUBE GROUP

TECHNICAL FIELD

The present invention relates to a large-sized reboiler (heat exchanger).

BACKGROUND ART

In recent years, the greenhouse effect caused by carbon dioxide has been pointed out as one cause for global warming phenomena, and there is a tendency that the demand of restraining the emission of carbon dioxide becomes more intense to protect the global environment. For a power generating facility such as a thermal power plant using a large amount of fossil fuel, there has been proposed a method in which carbon dioxide in combustion flue gas is removed and recovered by bringing the combustion flue gas of a boiler into contact with an amine-based carbon dioxide absorbing solution (Patent Document 1).

As a method for removing and recovering carbon dioxide from the combustion flue gas by using a carbon dioxide-absorbing solution, there has been employed a carbon dioxide recovery system in which the combustion flue gas is brought into contact with a carbon dioxide-absorbing solution in an absorption tower, and the absorbing solution having absorbed carbon dioxide is heated in a regeneration tower to liberate the carbon dioxide and to regenerate the absorbing solution, which is circulated again to the absorption tower for reuse. According to the carbon dioxide recovery system, carbon dioxide existing in a gas is absorbed by the absorbing solution in the absorption tower, subsequently the carbon dioxide is separated from the absorbing solution by heating the absorbing solution in the regeneration tower, the separated carbon dioxide is recovered separately, and the regenerated absorbing solution is circulatingly used again in the absorption tower. A reboiler is used to separate and recover the carbon dioxide by heating the absorbing solution in the regeneration tower.

Also, the reboiler is used for heat exchange between a liquid refrigerant and cold water, and as a result, the refrigerant is vaporized, while the cooled cold water is circulated in a building for air cooling (Patent Document 2).

PRIOR ART DOCUMENTS

Patent Documents

Patent Document 1: JP 2011-020090A
Patent Document 2: JP 2002-349999A

SUMMARY OF INVENTION

Technical Problem

The present inventors have aimed at saving space and reducing plant cost by combining a plurality of small-sized reboilers into one large-sized apparatus. However, They have found that in a reboiler which allows a liquid to be supplied from a lower part thereof, and the vaporized gas to be discharged from an upper part thereof, the gravity of the vaporized gas cannot be ignored so that the gas stays near an upper portion in a vessel and serves as a gas-form lid, thereby hindering the recovery of gas. The present invention provides a large-sized reboiler that prevents the vaporized gas from staying, and can achieve space saving and reduction in plant cost.

Solution to Problem

The present invention provides a large-sized reboiler comprising a vessel of which a liquid is supplied from a lower part and a vaporized gas is discharged from an upper part, and a heat transfer tube group arranged in such a manner that a void penetrating in an up-and-down direction is formed in the vessel, wherein a maximum length of a cross-sectional figure of a flow path for the liquid exceeds 2 m, and the void occupies 5 to 10% of an area of the cross-sectional figure of the flow path.

Effect of Invention

According to the present invention, although the size of a reboiler is made larger, a vaporized gas can be prevented from staying, and space saving and reduction in plant cost can be achieved.

DESCRIPTION OF EMBODIMENTS

Figure 1:
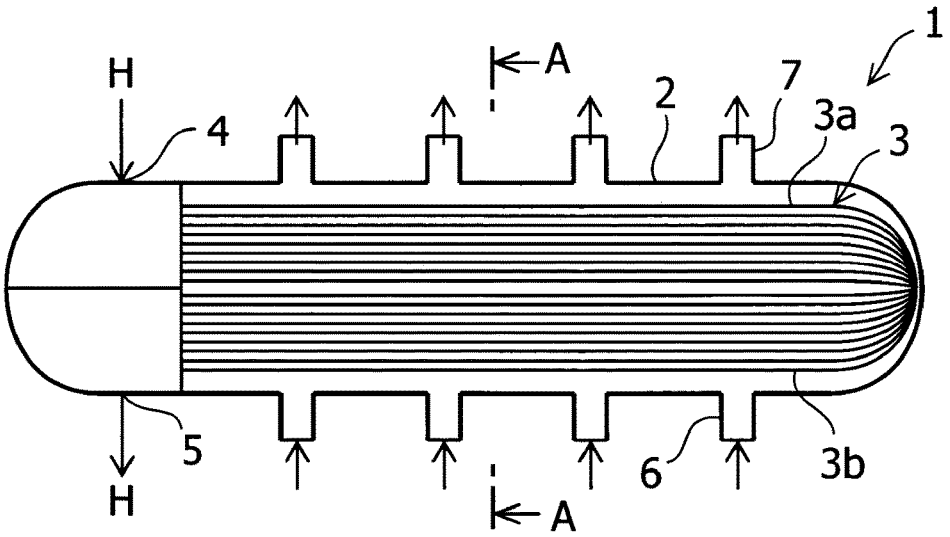
FIG. 1 is a schematic view showing a large-sized reboiler for recovering a gas (for example, carbon dioxide) from a liquid (for example, a carbon dioxide-containing absorbing solution).

FIG. 1 shows a large-sized reboiler 1 for recovering a gas (for example, carbon dioxide) from a liquid (for example, a carbon dioxide-containing absorbing solution). The reboiler 1 comprises a heat transfer tube group 3 in a cylindrical vessel 2 into which a liquid is supplied through lower inlets 6. The heat transfer tube group 3 comprises a bundle of a large number of heat transfer tubes through which a heating fluid H is allowed to flow, and lies in the longitudinal direction of the vessel 2. The heat transfer tube group 3 is divided into an advance-side heat transfer tube group 3*a*, which communicates with a heating fluid inlet 4, and a return-side heat transfer tube group 3*b*, which communicates with a heating fluid outlet 5. The heating fluid H flowing into the vessel 2 through the heating fluid inlet 4 goes in the vessel 2, turns back across the inside of the vessel 2, goes again in the vessel 2, and flows to the outside through the heating fluid outlet 5. In this process, the heating fluid H is heat-exchanged with a liquid introduced into the vessel 2 and cooled, while the liquid is heated by the heating fluid H and discharged through upper outlets 7 of the vessel as a mixture of gas (for example, carbon dioxide gas) and treated liquid (for example, an amine solution).

Figure 2:
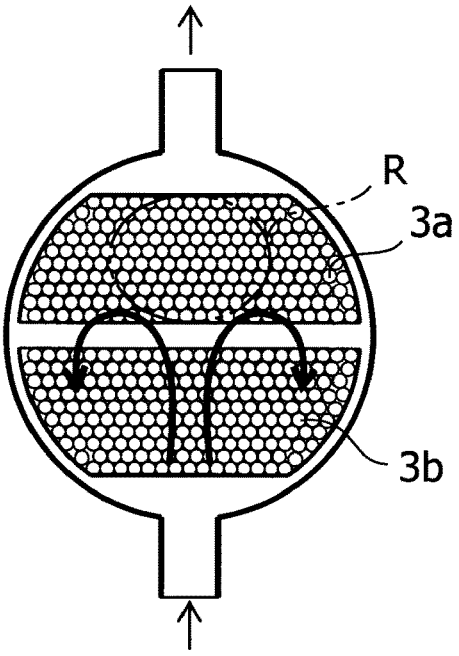
FIG. 2 is a sectional view taken along the line A-A of FIG. 1, showing an embodiment in which the heat transfer tube group is arranged in the same manner as that in a small-sized reboiler.

FIG. 2 is a sectional view taken along the line A-A of FIG. 1, and shows an embodiment in which the heat transfer tube group is arranged in the same manner as that in a small-sized reboiler. In this large-sized reboiler of which a liquid is supplied from a lower part and a vaporized gas is discharged from an upper part, since an amount of the liquid to be treated is large, the vaporized gas stays near the upper portion in the vessel owing to the gravity of the vaporized gas, thereby forming a region R of staying vapor. The staying vapor serves as a lid so that the liquid circulates under the staying vapor (indicated by arrows in FIG. 2), lowering the vapor recovery efficiency.

Figure 3:
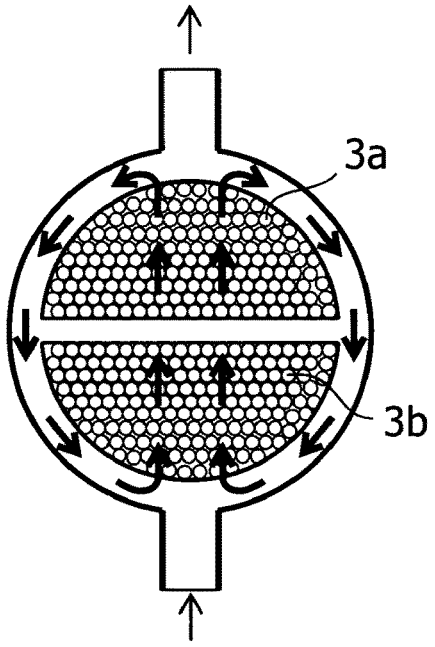
FIG. 3 is a sectional view taken along the line A-A of FIG. 1, showing an embodiment in which the heat transfer tube group is arranged in such a manner that a void is formed between the periphery of an inner wall in the up-and-down direction of a reboiler vessel and the heat transfer tube group.

FIG. 3 is a sectional view taken along the line A-A of FIG. 1, showing an embodiment in which the heat transfer tube group is arranged in such a manner that a void penetrating in the up-and-down direction of the reboiler vessel is formed. FIG. 3 shows an embodiment in which the heat transfer tube group is arranged in such a manner that a void is formed between the periphery of an inner wall in the up-and-down direction of the reboiler vessel and the heat transfer tube group. In the other words, this embodiment is one in which a downcomer, which is a ring-shaped void, is provided between the heat transfer tube group and a shell, whereby the vapor and the liquid are separated from each other, and also the flow rate of the liquid is increased. The increase in the flow rate of the liquid circulating in the heat transfer tube group allows the area in which the liquid is in contact with the heat transfer tube group to increase, so that the heat-exchanging performance is enhanced. Also, since the stay of vapor can be avoided, the liquid is easy to flow, and the heat exchange of the liquid with the heating fluid is promoted, so that the improvement in heat transfer rate can be achieved. The deviation of boiling in the longitudinal direction perpendicular to the up-and-down direction is eliminated, and thereby the average heat transfer performance of a vaporizer can be improved. The heat transfer rate between each heat transfer tube and air bubbles is lower than the heat transfer rate between each heat transfer tube and the liquid. However, since the formation of the air bubbles is suppressed, the decrease in the heat transfer rate is restrained.

Figure 4:
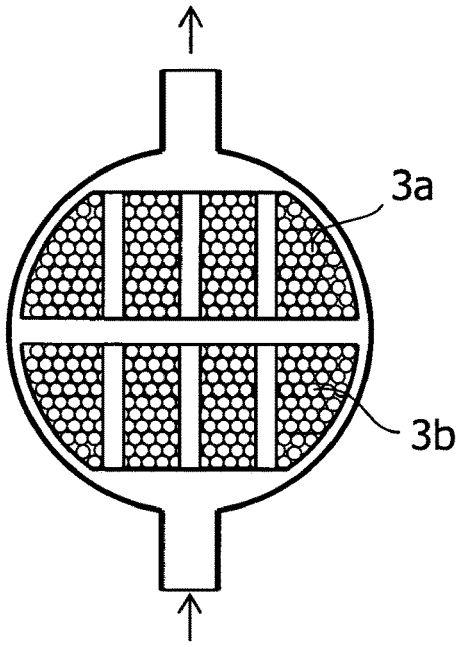
FIG. 4 is a sectional view taken along the line A-A of FIG. 1, showing one embodiment in which voids penetrating in the up-and-down direction are formed within the heat transfer tube group.

FIG. 4 is a sectional view taken along the line A-A of FIG. 1, showing an embodiment in which the heat transfer tube group is arranged in such a manner that a void penetrating in the up-and-down direction of the reboiler vessel is formed. FIG. 4 shows an embodiment in which voids penetrating in the up-and-down direction are formed within the heat transfer tube group. In other words, columnar voids are provided within the heat transfer tube group, so that the vapor does not stay within the heat transfer tube group, and easily comes out upward. Easy separation of the vapor from the liquid facilitates the liquid to easily come into contact with the heat transfer tube group, so that the heat-exchanging performance is enhanced. The liquid can be supplied sufficiently to the upper heat transfer tubes in the heat transfer tube group. Therefore, the heat transfer performance of the upper heat transfer tubes is improved, so that the boiling performance is improved. The heat transfer rate between each heat transfer tube and air bubbles is lower than the heat transfer rate between each heat transfer tube and the liquid. However, since the formation of the air bubbles is suppressed, the decrease in the heat transfer rate is restrained.

Although not shown in figures, an embodiment in which those in FIGS. 3 and 4 are combined can also be used. There may be used an embodiment in which the voids are formed in the vessel of which the liquid is supplied from the lower part and the vaporized gas is discharged from the upper part, and penetrate in the up-and-down direction between the periphery of the inner wall in the up-and-down direction of the vessel and the heat transfer tube group, as well as within the heat transfer tube group.

In the large-sized reboiler described in this specification, the maximum length of the cross-sectional area of a flow path for the liquid, that is, the maximum length of the cross-sectional area in the longitudinal direction usually perpendicular to the up-and-down direction is larger than 2 m, preferably 3 m or larger, and further preferably 4 m or larger. The upper limit of the maximum longitudinal length of the cross-sectional area is not subject to any special restriction, and is determined in consideration of the quantity of liquid treated by the reboiler and the content and efficiency of the subsequent treatment of the recovered gas and the liquid from which the gas has been removed. Also, when the length or the shell diameter is large, an embodiment in which a vertical-type reboiler is used is also available, and therefore the upper limit of the maximum longitudinal length is not restricted especially.

The maximum length of the cross-sectional figure of the flow path in the longitudinal direction is, for example, a diameter when the cross-sectional figure of the flow path is a circle, a major axis when it is an ellipse, and the longest diagonal line when it is a polygon such as a triangle, a quadrangle or an octagon.

In the area of the cross-sectional figure of the flow path in the vessel of which the liquid is supplied from the lower part and the vaporized gas is discharged from the upper part, that is, in the area of the cross-sectional figure of the flow path in the longitudinal direction usually perpendicular to the up-and-down direction, the void penetrating in the up-and-down direction preferably occupies an area of 5 to 10%, while the heat transfer tube group preferably occupies a space of 90 to 95% by ignoring the longitudinal space between the tube group on the return side and the tube group on the advance side. Therefore, as described relating to FIGS. 3 and 4, the vapor does not stay in the upper portion of the heat transfer tube group, and easily comes out upward. Easy separation of the vapor from the liquid facilitates the liquid to easily come into contact with the heat transfer tube group, so that the heat-exchanging performance can be enhanced. When the void area is less than 5% of the cross-sectional area of the flow path, the vapor stays. When the void area is more than 10%, the heat transfer efficiency decreases.

The liquid to be treated by the reboiler is not particularly limited as long as it generates a gas by heating, and includes an amine solution having absorbed carbon dioxide and a liquid-form refrigerant. The amine solution having absorbed carbon dioxide is heated by the reboiler so that the amine solution is regenerated with generation of carbon dioxide. A liquid refrigerant is also treated by the reboiler, and heat exchange is carried out between the liquid refrigerant in the reboiler vessel and water caused to flow in the heat transfer tubes, thereby vaporing the liquid refrigerant and circulating the cooled water through tubes laid in a structure, whereby cooling is performed through heat exchange with air in each space.

When the circulation ratio of the liquid to be treated by the reboiler is less than 3, the generation of gas may become unstable. The circulation ratio is preferably 10 or more. The circulation ratio is expressed by the equation: $(G_f+G_g)/G_f$ wherein $G_f$ is the flow rate (weight) of the circulating liquid, and $G_g$ is the flow rate (weight) of the generating gas.

The throughput of the liquid in the reboiler is determined by considering the quality and/or capacity of treatment in the succeeding process.

EXAMPLE

Examples 1 and 2, and Comparative Example 1

Figure 5A:
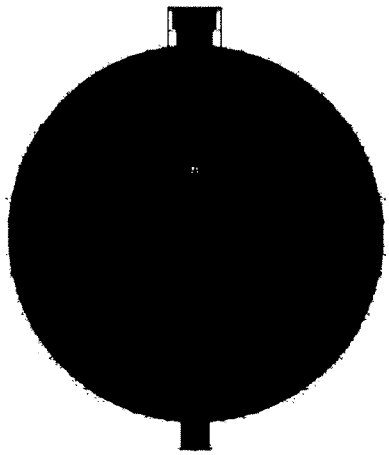
FIG. 5 is a sectional view taken along the line A-A of FIG. 1, wherein FIG. 5(*b*) shows an arrangement in which a void is formed between the periphery of an inner wall in the up-and-down direction of the reboiler vessel and the heat transfer tube group, while FIG. 5(*a*) shows a blackened or black-colored region in which the vapor quality of the heat transfer tube group in said arrangement is 0.1 or less.
Figure 5B:
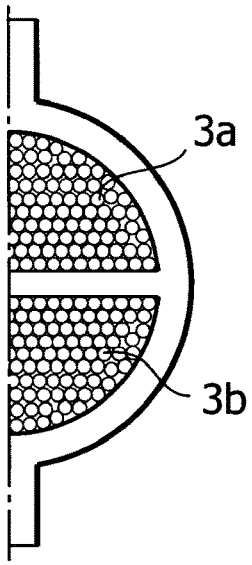
Figure 6A:
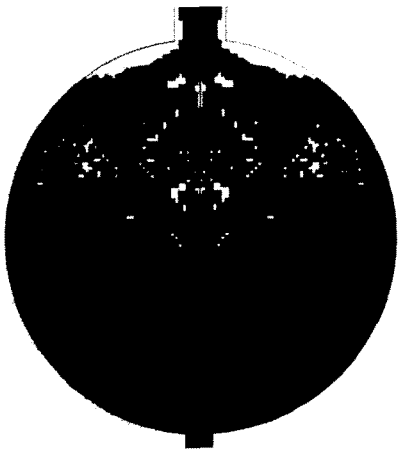
FIG. 6 is a sectional view taken along the line A-A of FIG. 1, wherein FIG. 6(*b*) shows an arrangement in which voids penetrating in the up-and-down direction are formed within the heat transfer tube group, while FIG. 6(*a*) shows a blackened or black-colored region in which the vapor quality of the heat transfer tube group in said arrangement is 0.1 or less.
Figure 6B:
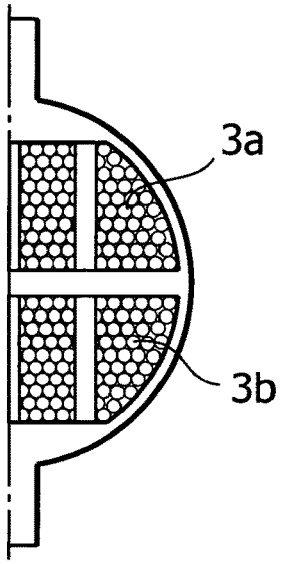
Figure 7A:
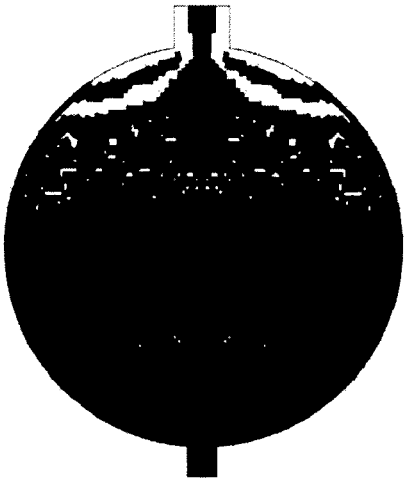
FIG. 7 is a sectional view taken along the line A-A of FIG. 1, wherein FIG. 7(*b*) shows an arrangement of the heat transfer tube group in the same manner as that in a small-sized reboiler, while FIG. 7(*a*) shows a blackened or black-colored region in which the vapor quality of the heat transfer tube group in said arrangement is 0.1 or less.
Figure 7B:
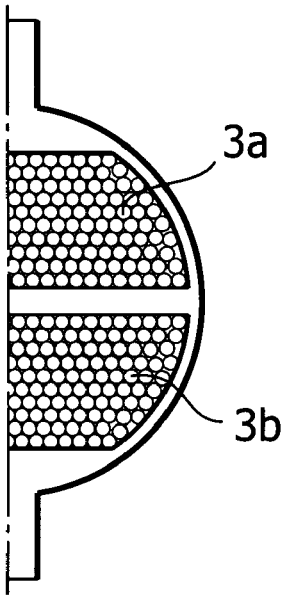

FIGS. 5 to 7 show analysis data of changing the arrangement of the heat transfer tube group in the large-sized reboiler shown in FIG. 1, in which the cross-sectional area of the flow path for the liquid is a rectangle of 2 m×3 m, and the diagonal line of the rectangle, which is the maximum length, is 3.6 m, and the liquid having a temperature of 118° C. is heated to 123° C. through heat exchange at a liquid flow rate of 50 kg/m$^2$s (at the outlet of heat transfer tube group). FIGS. 5 to 7 correspond to the sectional view taken along the line A-A of FIG. 1. In FIGS. 5(*a*) to 7(*a*), a region in which the vapor quality is 0.1 or less, is blackened or shown in black color. The vapor quality is the weight ratio of the vapor to the mixture of the liquid and the vapor from the liquid. In FIGS. 5(*b*) to 7(*b*), the arrangement of the heat transfer tube group is shown in a half of the A-A section of FIG. 1.

Example 1 shown in FIG. 5 is an embodiment in which the heat transfer tube group is arranged in such a manner that a void is formed between the periphery of the inner wall in the up-and-down direction of the reboiler vessel and the heat transfer tube group. As shown in FIG. 5(*a*), this embodiment has the vapor quality of 0.1 or less excluding only a part, and a high heat transfer efficiency. A region in which the vapor quality x is high (x exceeds 0.1 at the atmospheric pressure) is reduced, which lowers the possibility that the heat transfer tubes are dried out.

Example 2 shown in FIG. 6 is an embodiment in which voids penetrating in the up-and-down direction are formed within the heat transfer tube group. As shown in FIG. 6(*a*), although the existing ratio of a region in which the vapor quality exceeds 0.1 increases in the upper portion of vessel, an allowable heat transfer efficiency is obtained.

Comparative Example 1 shown in FIG. 7 is an embodiment in which the heat transfer tube group is arranged in the same manner as that in a small-sized reboiler. As shown in FIG. 7(*a*), the existing ratio of a region in which the vapor quality exceeds 0.1 is high in the upper portion of vessel, and a poor heat transfer efficiency is obtained.

EXPLANATION OF SYMBOLS

1: large-sized reboiler
2: vessel
3: heat transfer tube group
3*a*: advance-side heat transfer tube group
3*b*: return-side heat transfer tube group
4: heating fluid inlet
5: heating fluid outlet
6: lower inlet
7: upper outlet
H: heating fluid
R: region of staying vapor

The invention claimed is:

1. A large-sized reboiler comprising:

a vessel into which a liquid is supplied from a lower part and a vaporized gas is discharged from an upper part; and a heat transfer tube group arranged in such a manner that a void penetrating in an up-and-down direction is formed in the vessel, wherein a maximum length of a cross-sectional figure in a longitudinal direction perpendicular to the up-and-down direction exceeds 2 m, and the void occupies 5 to 10% of an area of the cross-sectional figure, and wherein the void penetrates in the up-and-down direction within the heat transfer tube group and the void exists between the periphery of an inner wall in the up-and-down direction of the vessel and the heat transfer tube group so as to be ring-shaped.

* * * * *